US005212030A

United States Patent [19]

Figov

[11] Patent Number: 5,212,030

[45] Date of Patent: May 18, 1993

[54] METHOD AND MATERIALS FOR PRODUCING A PRINTING MASTER

[75] Inventor: Murray Figov, Raanana, Israel

[73] Assignee: Plazer Ltd., Ramat Gan., Israel

[21] Appl. No.: 439,704

[22] Filed: Nov. 21, 1989

[51] Int. Cl.[5] ..... G03G 13/28

[52] U.S. Cl. ..... 430/49; 430/281

[58] Field of Search ..... 430/49, 281

[56] References Cited

U.S. PATENT DOCUMENTS

| | | | |
|---|---|---|---|
| 2,735,784 | 2/1956 | Greig et al. . | |
| 2,987,395 | 6/1961 | Jarvis . | |
| 3,714,891 | 2/1973 | Van Dusen Jr. et al. | 101/451 |
| 4,149,798 | 4/1979 | McGowan et al. | 355/8 |
| 4,253,999 | 3/1981 | Okishi et al. | 430/155 |
| 4,266,481 | 5/1981 | Garrett et al. | 430/302 |
| 4,457,992 | 7/1984 | Bhattacharjee et al. | 430/49 |
| 4,504,406 | 3/1985 | Dhillon | 252/135 X |
| 4,567,490 | 1/1986 | Afzali-Ardakani et al. | 428/323 X |
| 4,699,862 | 10/1987 | Khe et al. | 430/93 |
| 4,748,098 | 5/1988 | Schell | 430/49 |
| 4,774,532 | 9/1988 | Ninomiya et al. | 346/160 |
| 4,883,731 | 11/1989 | Tam et al. | 430/41 |
| 4,886,553 | 12/1989 | Gillich | 134/42 |

FOREIGN PATENT DOCUMENTS

| | | |
|---|---|---|
| 2607207 | 9/1977 | Fed. Rep. of Germany . |
| 2726263 | 12/1978 | Fed. Rep. of Germany . |
| 1215437 | 12/1970 | United Kingdom . |
| 2110161 | 6/1983 | United Kingdom . |
| 2146582 | 4/1985 | United Kingdom . |

*Primary Examiner*—Marion E. McCamish
*Assistant Examiner*—S. Crossan
*Attorney, Agent, or Firm*—Edward Langer

[57] ABSTRACT

A specially coated paper which has been prepared for imaging in an electrophotographic reproduction process, and a method for developing an image produced on this paper so that it may be used as a lithographic printing plate. The base material is polyester and is coated with either a thermoplastic or cross-linking resin or mixture of resins. The layer which is used for coating the polyester is loaded with zinc oxide. Once the printing plate has been prepared, it is then imaged in a photocopier or laser printer using the indirect electrophotographic process. Background dots can then be eliminated by application of a specific mixture to the printing plate before printing. The mixture preferably consists of an emulsion with an external hydrophilic phase, and an internal lipophylic/solvent phase held together by a surfactant or mixture of surfactants. Optionally, the external phase may also contain an aqueous solution of ferrocyanide or tannic acid or any other known conversion agent so that it may be applied to the plate without the need for previously etching it with the conventional electrostatic conversion etch. The plates may be imaged in laser printers, so that printing plates may be obtained directly from both digital and analog information on equipment that need not be dedicated to such use, which is already owned by potential users.

10 Claims, 1 Drawing Sheet

METHOD AND MATERIALS FOR PRODUCING A PRINTING MASTER

FIELD OF THE INVENTION

The present invention relates to printing materials and methods, and more particularly, to a specially coated paper or polyester base material which has been prepared for imaging in an indirect electrophotographic reproduction process, and to a method for developing an image produced on this paper or polyester base material so that it may be used as a lithographic printing plate.

BACKGROUND OF THE INVENTION

During the past twenty years, a cheap and convenient method of producing paper printing plates has become popular. This has been developed as an off-shoot of the direct electrophotographic copying process (Electrofax) developed by RCA (see, for instance, U.S. Pat. No. 2,987,395), whereby paper, having a dye-sensitized zinc oxide resinous layer, is charged and light exposed to produce an electrostatic charge pattern. This pattern is then developed with a resinous carbon powder which may be, for instance, either liquid borne or carried triboelectrically in a magnetic brush.

In order to obtain customer acceptability, the copy produced by this process had to be white in appearance and of such a substance as to appear as similar to ordinary paper as possible. The white color was achieved by using a combination of differently colored sensitizing dyes.

In U.S. Pat. No. 2,735,784 there is described a process for producing a planographic printing plate in which a heavy duty paper is used, and there is no constraint on the color of the plate from the point of view of customer acceptability, making the choice of sensitizing dyes simpler. However, in order to use such a master for the purposes of printing, it is necessary that the print areas are ink receptive and the background areas water receptive. The former property is generally an outcome of the developer used in the copying process, but in order to achieve the water receptive/ink repellent properties of the background areas, it is necessary to treat the master after imaging with what has become known as a conversion etch. One such etch is for instance described in U.S. Pat. No. 3,714,891. Generally, use is made of a ferrocyanide solution to convert the zinc oxide on the surface of the master to the water-receptive zinc ferrocyanide.

Although it has been claimed that such plates may be made of plastic or even metal, this has not proven to be commercially successful. Plastic plates would be desirable over the paper plates because they would be more stable under printing conditions, as the plastic used could easily be water resistant. However, the necessity of having a conductive base material for the electrophotographic process to function has provided a considerable barrier to satisfactory development, as, in general, plastics do not have the low electrical resistance required. The disadvantage of the present paper plates is that they absorb water used in the printing process and this causes stretching and cockling and limits plate life.

When the process was first commercially exploited, it was possible to buy a machine which could be used as a copier and could also be used to make a printing master. However, parallel to the development of the direct electrophotographic process was the development of the indirect (Xerographic) process whereby the imaging is done onto a drum or continuous band of electrophotosensitive material such as amorphous silicon, and the image developed with a subsequent offset of the image onto plain paper. This process was preferred by customers because they wanted their copies on plain paper. The Electrofax process could only produce coated paper that did not feel like plain paper, was easily marked, for instance with a coin, and was at best off-white in appearance.

Consequently, with the growth in popularity of the plain paper copier, the Electrofax process declined to a more limited market of machines dedicated solely to reproducing paper offset masters. This is less desirable to the customer who often has to purchase and maintain both copying and plate-making machines, with the latter being more expensive because of their more limited market.

A further development in printing has occurred with the advent of the computer and especially the personal computer (PC) and the introduction of Desk Top Publishing. With appropriate software programs, it is possible to generate within the computer all kinds of graphical and typesetting designs for the purpose of subsequent printing, thus eliminating long hours of arduous preparation by hand. The digital information must be converted to hard copy which may subsequently be used to produce a printing plate. A suitable method that has been developed is to use the digital signal generated by the computer to modulate a laser beam as a means of imaging in the indirect or Xerographic process, and laser printers are now widely sold for this. The resulting hard copy is then used, either as an original on an electrostatic plate-maker, or to produce a transparent film that can be then used as a master for a metal offset plate.

While the advantages of generating an offset litho plate directly from digital information has been recognized in U.S. Pat. Nos. 4,149,798 and 4,774,532, these patents utilize the direct (Electrofax) electrophotographic plate-making method as described above. Therefore, the equipment needed must be dedicated to plate making, and the type of plates made is, in practice, restricted to paper plates. German Patent No. 2,726,263 describes an aluminum based printing plate electrophotographically worked using laser imaging, but the limitation of using dedicated equipment applies equally to this invention. Moreover, it involves a wash-off process to hydrophilize the background. German Patent No. 2,607,207 uses laser imaging to produce a printing plate, but this is a non-electrophotographic process.

In my previous patent application GB 2,110,161 A, there is described an offset plate that can be imaged directly on a plain paper copier. Such plates were designed to work primarily with a plain paper technology involving cold-pressure fusing of the image and development by cold pressure fusing. However, it has been found that the main problem in utilizing such plates is that, frequently during imaging, extraneous background dots appear on the plate.

While background dots are imperceptible to the human eye in the production of a final hard copy directly from the plain paper coper, if the copy is used as a printing plate, inevitable dot enlargement occurs during printing and such dots then appear as an undesirable, clearly visible background. It is this problem that would preclude the commercial exploitation of the idea described above, and even if the idea had occurred to anyone to apply such technology to laser printing, this problem would have precluded its consideration.

Therefore, it would be desirable to provide a method of economically producing printing masters, free of undesirable background, by use of commercially available plain paper reproduction equipment based on the electrophotographic process.

SUMMARY OF THE INVENTION

Accordingly, it is a principal object of the present invention to provide a method of directly imaging a printing plate on an existing commercially available laser printer, utilizing the indirect (Xerographic) electrophotographic method.

It is another object of this invention to provide a printing plate that will accept all types of imaging whether they be of a digital or analogue nature so long as the method of image development is by indirect (Xerographic) electrophotography.

It is still a further object of this invention to provide the means and materials to convert the image produced on the master into a printing plate that may be used to produce good quality prints, free from undesirable background.

In accordance with a preferred embodiment of the present invention, there is provided a method of producing a printing plate using the indirect electrophotographic process, said method comprising the steps of:

coating a printing plate with a base material of polyester;

coating said base material with a pigment-loaded resin;

imaging said coated printing plate in an indirect electrophotographic process, forming image areas;

applying a conversion etch solution for etching said image areas; and applying a background cleaning mixture to said etched image areas to remove unwanted background image.

In the preferred embodiment of the invention, the base material is polyester and is coated with either a thermoplastic or cross-linking resin or mixture of resins. The polyester base material enables production of a printing plate that does not damage easily, is not affected by moisture and does not stretch, thereby eliminating problems of register in multicolor printing.

The layer which is used for coating the polyester is loaded with zinc oxide in quantity sufficient such that after conversion to water-receptive zinc ferrocyanide by use of a conversion etch, long runs of satisfactory copies are obtained.

In accordance with the method of the invention, the printing plate prepared as described above is then imaged in a photocopier or laser printer using the indirect electrophotographic process. Background dots can then be eliminated by application of a specific mixture to the printing plate before printing. The mixture preferably consists of an emulsion with an external hydrophilic phase, and an internal lipophilic/solvent phase held together by a surfactant or mixture of surfactants. Optionally, the external phase may also contain an aqueous solution of ferrocyanide or tannic acid or any other known conversion agent so that it may be applied to the plate without the need for previously etching it with the conventional electrostatic conversion etch.

It is a feature of the invention to utilize plates of the type described in GB 2,110,161 A for imaging in laser printers, so that printing plates may be obtained directly from both digital and analog information on equipment that need not be dedicated to such use, which is already owned by potential users.

Other objects of this invention and its various advantageous features will become apparent from the detailed description which follows.

BRIEF DESCRIPTION OF THE DRAWING

For a better understanding of the invention with regard to the embodiments thereof, reference is made to the accompanying drawing (FIG. 1) which depicts a printing plate coated with materials and prepared for production in an electrophotographic process.

DETAILED DESCRIPTION OF THE PREFERRED EMBODIMENTS

Figure 1:
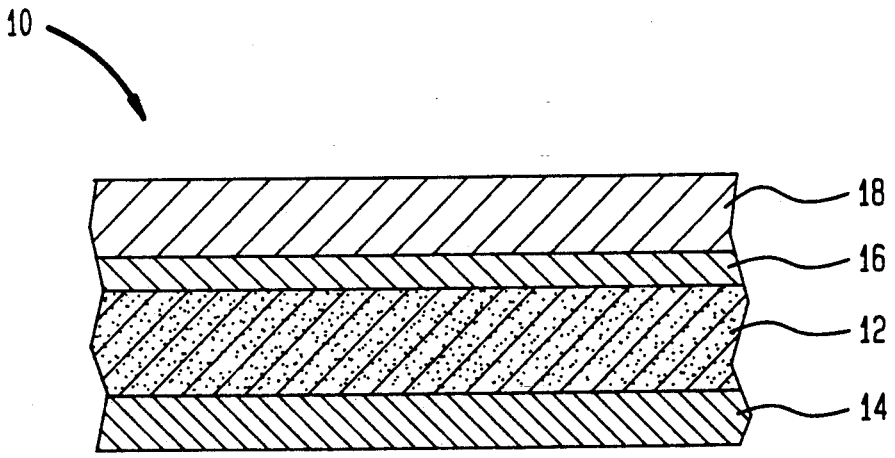

In accordance with a preferred embodiment for practicing the present invention, a printing plate 10 having the structure shown in FIG. 1 is used. A base substrate 12 may be a completely moisture-free material such as polyester, or may be a paper base material, sealed either from the back (layer 14) or front (layer 16) or on both back and front surfaces (layers 14 and 16). The preferred base material is polyester, as it enables the production of a printing plate that does not damage easily, is not affected by the moisture applied to it during the printing process, and does not stretch so that such plates can be used for color printing without problems of register.

The base 12 or the front layer 16 is coated with a layer 18 which comprises either a thermoplastic or a cross-linking resin or mixture of resins, loaded with zinc oxide and optionally a filler such as calcined aluminum silicate or calcium carbonate. The quantity of zinc oxide must be sufficient that after conversion by a conventional electrostatic etch and treatment with the treating emulsion to be described, long runs of satisfactory copies are obtained. This quantity depends on the nature of the resin, as well as the nature and quantity of the filler.

The pigment-to-binder ratio is restricted by the adhesion of the resulting layer to the chosen base material, so that for instance in the case of thermoplastic resins on polyester a ratio of 3:1 cannot be exceeded. The resin should have very good adhesive properties as well as good water resistance and the ability to produce a film sufficiently tough to withstand the impacting forces experienced during printing. The preferred type of resin is a crosslinking one, because, while it may be coated from solvent, it may produce a solvent-resistant layer that is especially suitable for working this invention.

GB 2,110,161 A was primarily addressing a problem of imaging a printing plate with a mono-component toner. Such toners possess a magnetic ferrite that transfers to the final copy. As this may make the toner relatively conductive, it makes the transfer to the final copy paper more susceptible to moisture, and the plate compositions bear related restrictions. As the present generation of copiers and laser printers are predominantly using two component developers, the compositions for working this invention are wider in this respect.

When such a printing plate as is described above is imaged in a photocopier or a laser printer, a good quality image is formed. If this image is examined under a low power microscope, frequently small toner particles can be seen to be fused to the background both in areas where there is no image and around the areas of each image character. If the plate is now etched with a conventional electrostatic conversion etch and run on a conventional offset litho printing machine using a diluted etch as the fount, printed copies are obtained, but with the spots that were only visible under a microscope now being clearly visible as unacceptable background.

It has now been found possible to eliminate this background by application of a specific mixture to the plate before printing. This mixture may consist of an emulsion with an external hydrophilic phase, and an internal lipophilic/solvent phase held together by a surfactant or mixture of surfactants. The use of the work "solvent" here and subsequently in this context is taken to refer to solvents for the resins that are used in the toners that are deposited as the black print areas of the printing plate. Optionally, the external phase may also contain an aqueous solution of ferrocyanide or tannic acid or any other known conversion agent so that it may be applied to the plate without the need for previously etching it with the conventional electrostatic etch.

It has been discovered that results are remarkably better than anticipated, because on investigation it was found that the emulsion acts simultaneously in a variety of ways. Some of the small particles that are only fused very shallowly to the surface of the plate are wiped off from the mild attack of the solvent in the internal phase of the emulsion. Besides cleaning the background, the emulsion also acts as a dot etch so that the sharpness of the print obtained from the plate is improved. In addition, the lipophilic internal phase is absorbed onto the surface of the print and a darker print results. It would be expected that this would also apply to any small background particles that remain, but it appears that for very small particles, the hydrophilic phase has the predominant effect.

Using the special emulsion, it is also possible to print with a higher concentration of etch in the fount. If this is done without the emulsion treatment, salts from the etch may become slightly absorbed into the print areas of the plate reducing the ink attracting properties of these areas, and the resulting prints are light. Because the oleophilic nature of the print has been enhanced by the emulsion, the emulsion is able to act as protection against the etch and the dark print is retained, but the clear background is achieved. The external hydrophilic phase of the emulsion as a diluent against solvent attack of both the print and the plate material, and also aids in preventing any initial scumming due to the presence of solvent when the plate is run on the press.

While it has been found that the liquid used as described above may be an emulsion, this invention does not exclude the use of a one-phase liquid which contains the hydrophilic and oleophilic elements held together by a cosolvent. It is also possible to include in the emulsion or one-phase liquid such elements as are known to aid offset materials. These include acids and hydrophilic resins to encourage good fount receptivity, and lipophilic resins to improve image ink receptivity.

It is well established that the underlying basis of the offset litho printing process is the need to make the print areas ink receptive and the background areas water receptive. It is frequently the case that this is achieved by the use of a liquid. The primary function of this liquid may be to hydrophilise the background areas as described for instance in U.S. Pat. No. 3,714,891, or to make the image oleophilic as for instance in GB 2,146,582 A. This latter patent (which is concerned with a silver diffusion transfer offset plate) claims the use of very small quantities of solvent to clean the background, but it is clear from the claims that this is to inhibit the inking of background. The primary functioning of the mixture of the present invention differs from these disclosures in that it seeks to eliminate or reduce unwanted print areas rather than just to keep non-image areas free from ink.

In addition, it was found that a plate such as one of those described above could be used on a laser printer to give a mirror image on its surface, wiped with the mixture, dried, and the plate then exposed emulsion-to-emulsion on a conventional positive-working metal offset plate using u.v. light.

Typically, the external phase of the emulsion may be water or a glycol or glycerine or a combination of these substances or any other water miscible substance. The internal phase typically consists of petroleum ether, mineral oil, benzyl alcohol, dibutyl phthalate, cyclohexanol, cellosolve or cyclohexanone or any combination that would make a uniform solution. The emulsifactant can be ionic or non-ionic with an H.L.B. (hydrophilic/-lipophilic balance) of over ten. Typically, this is a sulfated/sulfonated vegetable oil or an ethoxylated oil. It must be noted that such an emulsion, if it contains too much solvent, would attack both the plate surface and the print area.

Where the plate is made from a cross-linked resin, it is possible to produce a plate that is unattacked by any amount of solvent in the mixture, and in such a case where there are large background areas they can be wiped clean with the pure solvent and the plate can be corrected by removing image areas directly with the solvent. Where the mixture is used on the print areas of such a plate or on the entire areas of the other above-mentioned plates, it is necessary that the solvent content plus the surfactant does not exceed 30%.

EXAMPLE 1

The following ingredients were mixed together:

| | |
|---|---|
| Glycerine | 40 parts |
| Water | 10 parts |
| Monoethylene glycol | 10 parts |
| Sulfated vegetable oil | 1 part |

A separate mixture of the following ingredients was then made:

| | |
|---|---|
| Cyclohexanone | 2 parts |
| Mineral oil | 12 parts |

The oil phase was slowly added to the other phase with high speed stirring to form a uniform emulsion.

A printing plate (as described above) was imaged on a laser printer and swabbed with cotton wool with an electrostatic etch. It was then swabbed with the above emulsion and run on an offset litho machine using a fount of 4:1 water to etch solution. Excellent prints free of all background were obtained.

EXAMPLE 2

The following ingredients were mixed together:

| | |
|---|---|
| Water | 100 parts |
| Tri-methylol propane | 40 parts |
| Sodium lauryl sulfate | 2 parts |

A separate mixture of the following ingredients was then made:

| | |
|---|---|
| Tritolyl phosphate | 14 parts |
| Sulfated castor oil | 10 parts |

The second mixture was slowly added to the first with high speed stirring and the emulsion used as in Example 1.

Having described the invention with regard to certain specific embodiments thereof, it is to be understood that the description is not meant as a limitation since further modifications will now suggest themselves to those skilled in the art and it is intended to cover such modifications as are covered in scope of the appended claims.

I claim:

1. A method of producing a printing plate using the indirect electrophotographic process, said method comprising the steps of:

coating a polyester printing plate base material with a pigment-loaded resin;

imaging said coated printing plate in an indirect electrophotographic process, forming image areas;

applying a conversion etch solution for etching said image areas; and applying a background cleaning mixture to said etched image areas to improve the sharpness thereof while simultaneously removing unwanted background image formed by toner particles, wherein said background cleaning mixture is an emulsion comprising an external hydrophilic phase of water, a humectant and an acid, at least one surfactant with an HLB greater than 10, and an internal lipophilic phase consisting of an oil and an organic solvent, where the total surfactant and lipophilic phase are a total weight of less than 30%;

and wherein the strength of said organic solvent in said background cleaning mixture is 2.7% by weight, to remove said unwanted background image while sharpening said etched image areas.

2. A method of producing a printing plate using the indirect electrophotographic process, said method comprising the steps of;

coating a polyester printing plate base material with a pigment-loaded resin;

imaging said coated printing plate in an indirect electrophotographic process, forming image areas;

applying a conversion etch solution for etching said image areas; and applying a background cleaning mixture to said etched image areas to improve the sharpness thereof while simultaneously removing unwanted background image formed by toner particles, wherein said background cleaning mixture is an emulsion comprising an external hydrophilic phase of water, a humectant and an acid, at least one surfactant with an HLB greater than 10, and an internal lipophilic phase consisting of an oil and an organic solvent, where the total surfactant and lipophilic phase are a total weight of less than 30%;

and wherein the strength of said organic solvent in said background cleaning mixture is 8.4% by weight, to remove said unwanted background image while sharpening said etched image areas.

3. The method of either of claims 1 or 2 wherein said imaging step is performed in a laser printer utilizing the indirect electrophotographic method.

4. The method of either of claims 1 or 2 wherein said imaging step is performed in a laser printer with a laterally inverted image and that same image is used, emulsion-to-emulsion, to image a metal offset printing plate with u.v. light.

5. The method of either of claims 1 or 2 wherein said imaging step is performed using a plain paper copier.

6. The method of either of claims 1 or 2 wherein in the emulsion comprising an external hydrophilic phase, at least one surfactant, and an internal lipophilic phase, the external hydrophilic phase of said emulsion contains ferrocyanide ions.

7. The method of either of claims 1 or 2 wherein said emulsion contains a desensitizing resin in the external hydrophilic phase.

8. The method of either of claims 1 or 2 wherein said emulsion contains a lipophilic resin in the internal lipophilic phase.

9. An emulsion for improving the sharpness of etched image areas while simultaneously removing unwanted background image areas formed by toner particles on an electrophotographically produced polyester printing plate, said emulsion comprising an external hydrophilic phase, an internal lipophilic phase, and a surfactant, wherein said external hydrophilic phase contains at least one of the group consisting of ferrocyanide ions, a desensitizing resin, or an acid, and said internal lipophilic phase contains a lipophilic resin and an organic solvent, and wherein the strength of said organic solvent in said emulsion is 2.7% by weight, to remove said unwanted background image while sharpening said etched image areas.

10. An emulsion for improving the sharpness of etched image areas while simultaneously removing unwanted background image areas formed by toner particles on an electrophotographically produced polyester printing plate, said emulsion comprising an external hydrophilic phase, an internal lipophilic phase, and a surfactant, wherein said external hydrophilic phase contains at least one of the group consisting of ferrocyanide ions, a desensitizing resin, or an acid, and said internal lipophilic phase contains a lipophilic resin and an organic solvent, and wherein the strength of said organic solvent in said emulsion is 8.4% by weight, to remove said unwanted background image while sharpening said etched image areas.

* * * * *